US006383091B1

(12) United States Patent
Maruko et al.

(10) Patent No.: US 6,383,091 B1
(45) **Date of Patent: *May 7, 2002**

(54) GOLF BALL

(75) Inventors: Takashi Maruko; Yutaka Masutani, both of Chichibu (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/294,205

(22) Filed: Apr. 20, 1999

(30) Foreign Application Priority Data

Apr. 20, 1998 (JP) ..... 10-125267

(51) Int. Cl.[7] ..... A63B 37/04; A63B 37/06

(52) U.S. Cl. ..... 473/373; 473/370; 473/373; 473/374; 473/376; 473/377; 473/378; 273/60; 273/228; 273/230; 273/235; 264/328.1

(58) Field of Search ..... 473/370, 373, 473/374, 376, 377, 378; 273/228, 230, 235, 60; 264/328.1

(56) References Cited

U.S. PATENT DOCUMENTS 698,516 A * 4/1902 Kempshall
1,182,605 A * 5/1916 Wadsworth
1,242,832 A * 10/1917 Stanley
1,482,232 A * 1/1924 Hazeltine
1,524,171 A * 1/1925 Chatfield
1,855,448 A * 4/1932 Hazeltine
2,055,326 A * 9/1936 Young
2,376,085 A * 5/1945 Radford
4,229,401 A * 10/1980 Pocklington ..... 264/248
4,367,873 A * 1/1983 Chang ..... 273/60 R
5,439,227 A 8/1995 Egashira et al.
5,490,674 A 2/1996 Hamada et al.
5,692,973 A 12/1997 Dalton
5,782,702 A * 7/1998 Yamagishi ..... 473/280
5,807,192 A * 9/1998 Yamagishi ..... 473/377
5,813,923 A * 9/1998 Cavallaro ..... 473/373
5,816,937 A * 10/1998 Shimosaka ..... 473/354
5,820,485 A * 10/1998 Hwang ..... 473/361
5,836,834 A * 11/1998 Masutani ..... 473/374
5,984,807 A * 11/1999 Wai ..... 473/376
6,045,460 A * 4/2000 Hayashi ..... 473/376

* cited by examiner

*Primary Examiner*—Peter Vo
*Assistant Examiner*—Paul Kim
(74) *Attorney, Agent, or Firm*—Sughrue Mion, PLLC

(57) ABSTRACT

In a golf ball comprising a core, an intermediate layer, and a cover, the core or the cover is provided with a plurality of protrusions penetrating into the intermediate layer, and the material of the protrusions has at least 8 units higher Shore D hardness than the material of the intermediate layer. The protrusions satisfy the applicable range of Euler's buckling formula. The golf ball has improved performance.

9 Claims, 1 Drawing Sheet

GOLF BALL

This invention relates to a golf ball comprising a core, an intermediate layer, and a cover, and more particularly, to such a golf ball in which the core or the cover is provided with protrusions penetrating into the intermediate layer.

BACKGROUND OF THE INVENTION

A variety of studies and proposals have been made to find a good compromise between flight distance and "feel" of golf balls. For solid golf balls comprising a solid core and a cover, one common approach is to construct the core and the cover into multilayer structures for adjusting their hardness and dimensions (including diameter and gage).

For example, U.S. Pat. No. 5,439,227 discloses a three-piece golf ball comprising a core, a cover inner layer and a cover outer layer, the cover outer layer being harder than the cover inner layer. U.S. Pat. No. 5,490,674 discloses a three-piece golf ball comprising a solid core of inner and outer layers and a cover, the core inner layer being harder than the core outer layer.

While the respective layers of most golf balls define smooth spherical surfaces, the golf balls disclosed in U.S. Pat. Nos. 2,376,085 and 5,692,973 have a core which is provided with outwardly extending protrusions for preventing the core from being offset during injection molding of the cover therearound. The protrusions in these golf balls are substitutes for the support pins used during injection molding. These patents do not attempt to positively utilize the shape effect of support pin-substituting protrusions, but rather intend to avoid incorporation of a distinct material in the cover by forming the protrusions from the same material as the cover.

SUMMARY OF THE INVENTION

An object of the invention is to provide a golf ball comprising a core, an intermediate layer and a cover wherein the core or cover is provided with a plurality of protrusions penetrating into the intermediate layer, thereby achieving a good compromise between flight distance and control, which has never been achieved in prior art golf balls.

The shape effect of respective layers of a golf ball was investigated. It is well known from the study of strength of materials that a beam supporting an axial compressive load gives rise to the buckling phenomenon that as the load increases, uniform compression becomes unstable and is shifted laterally whereby the beam is bent. The invention has been devised by applying the buckling phenomenon to a golf ball. Specifically, in a golf ball comprising a core, an intermediate layer, and a cover, the core or the cover is integrally provided with a plurality of protrusions penetrating into the intermediate layer, and the material of which the protrusions are made is harder than the material of which the intermediate layer is made. The protrusions each satisfy the applicable range of Euler's buckling formula:

$$L>\pi(EI/A\sigma_b)^{1/2}$$

wherein L is the length (mm) of the protrusion, E is the Young's modulus (MPa) of the material of the protrusion, I is the geometrical moment of inertia ($mm^4$) of the protrusion, A is the cross-sectional area ($mm^2$) of the protrusion, and $\sigma_b$ is the yield stress (MPa) of the material of the protrusion. Then the buckling phenomenon is applicable to the core or cover protrusions embedded in the intermediate layer.

When the ball is struck at a relatively high head speed, typically with a driver, the protrusions embedded within the intermediate layer give rise to a buckling phenomenon so that the ball is substantially deformed, which provides a reduced spin rate and an increased launch angle, resulting in an increased carry. When the ball is struck at a relatively low head speed, typically with a short iron, the protrusions within the intermediate layer does not give rise to a buckling phenomenon and the ball undergoes small deformation, which provides an increased backspin rate and maintains ease of control. With respect to the "feel" of the ball when hit, the ball gives a soft pleasant feel on driver shots and a tight full-body feel on short iron shots.

More particularly, when the ball is struck at a relatively high head speed as with a driver so that ball is given a large impact force, that force acts to cause the protrusions to buckle. On the other hand, when the ball is struck at a relatively low head speed as with a short iron so that the ball is given a small impact force, the protrusions do not buckle. In the former case of large impact force, the protrusions buckle so that the strength of the protrusions embedded in the intermediate layer does not substantially act and only the strength of the intermediate layer formed softer than the protrusions contributes. This results in a reduced spin rate and an increased carry. In the latter case of small impact force, the protrusions do not buckle so that the strength of the intermediate layer in a substantial sense is a combination of the strength of the intermediate layer in itself and the strength of the protrusions embedded therein, that is, higher than the strength of the intermediate layer in itself by a value attributable to the protrusions of higher hardness. Then the intermediate layer exhibits a harder behavior, leading to an increased spin rate. Therefore, in the golf ball having protrusions of higher hardness penetrating in the intermediate layer according to the invention, the intermediate layer with protrusions embedded therein exhibits a different behavior depending on the magnitude of impact force, that is, the number of golf club.

Accordingly, the present invention provides a golf ball comprising a core, an intermediate layer around the core, and a cover around the intermediate layer. The core or the cover is integrally provided with a plurality of protrusions penetrating into the intermediate layer. The material of which the protrusions are made has a Shore D hardness which is at least 8 units higher than the Shore D hardness of the material of which the intermediate layer is made. The protrusions satisfy the applicable range of Euler's buckling formula. Preferably, the protrusions each have a rounded planar shape at its top.

DESCRIPTION OF PREFERRED EMBODIMENTS

Figure 1:
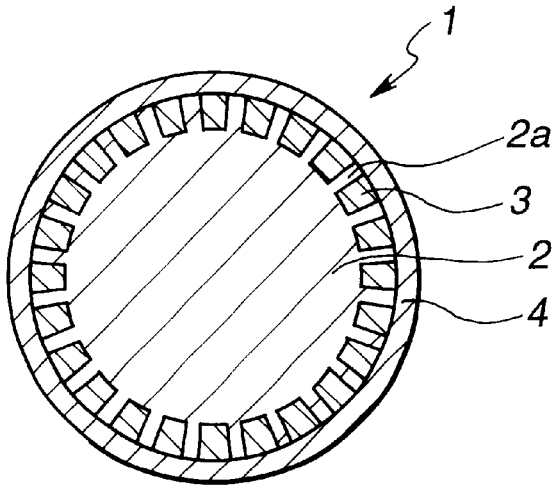
FIG. 1 is a schematic cross-sectional view of a golf ball according to one embodiment of the invention.
Figure 2:
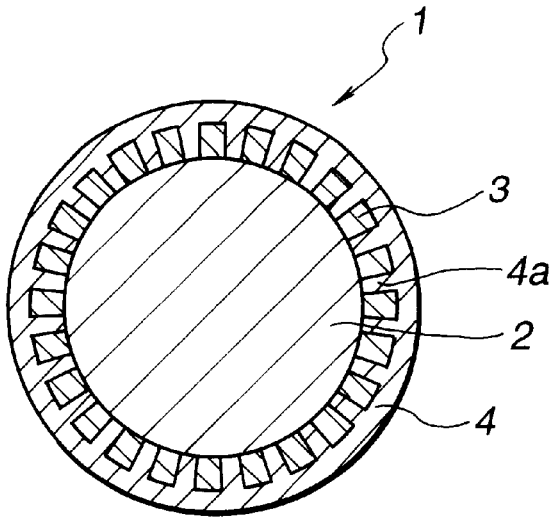
FIG. 2 is a schematic cross-sectional view of a golf ball according to another embodiment of the invention.

Referring to FIGS. 1 and 2, a golf ball according to the invention, designated at 1, is illustrated as comprising a solid core 2, an intermediate layer 3 enclosing the core 2, and a cover 4 enclosing the intermediate layer. The core 2 and cover 4 each may consist of either a single layer or plural layers. All these components are disposed in a concentric fashion.

In the golf ball of the invention, the core 2 is integrally provided with a plurality of outward protrusions 2*a* penetrating into the intermediate layer 3 as shown in FIG. 1. Alternatively, the cover 4 is integrally provided with a plurality of inward protrusions 4*a* penetrating into the intermediate layer 3 as shown in FIG. 2.

The material of which the protrusions are made (which is either the core material or the cover material) is harder than the material of which the intermediate layer is made. Specifically the Shore D hardness of the material of the protrusions is at least 8 units, preferably 10 to 50 units, higher than the Shore D hardness of the material of the intermediate layer. With a hardness difference of less than 8 Shore D units, the boundaries between the protrusions and the intermediate layer become less definite so that the shape effect of protrusions becomes weak. The intermediate layer excluding the protrusions should preferably have a Shore D hardness of 15 to 55, more preferably 20 to 50.

The protrusions or protruding columns embedded in the intermediate layer satisfy the following relation, that is, the applicable range of Euler's buckling formula used in the strength-of-materials theory.

$$L>\pi(EI/A\sigma_b)^{1/2}$$

In the relation, $\pi(EI/A\sigma_b)^{1/2}$is referred to as a protrusion coefficient. The protrusion coefficient, which varies with a particular material, should satisfy the relation representing the applicable range. That is, the protrusion coefficient should be smaller than the protrusion length L in order that the invention exert the desired effect.

Herein, L is the length (mm) of the protrusion, more particularly, the height of the protrusion or the depth of the recess, and is usually 1.0 to 6.0 mm, preferably 1.5 to 5.0 mm. A is the transverse cross-sectional area ($mm^2$) of the protrusion and is equal to $\pi d^2/4$ when the protrusion has a circular cross section having a diameter d. I is the geometrical moment of inertia ($mm^4$) of the protrusion and is equal to $\pi d^4/64$ when the protrusion has a circular cross section having a diameter d. A transverse cross section of the protrusion has a size of 0.5 to 5.0 mm, preferably 1.0 to 4.0 mm, which size corresponds to a diameter d when the protrusion has a circular cross section. E is the Young's modulus (MPa) of the material of the protrusion, and $\sigma_b$ is the yield stress (MPa) of the material of the protrusion. E and $\sigma_b$ and may be selected as appropriate since they differ depending on a particular material used and cannot be specified. For those materials which do not exhibit the definite yield stress at which plastic deformation suddenly takes place, the stress at which the permanent set exceeds 10% may be used as a substitute for the yield stress $\sigma_b$.

As is evident from Euler's buckling formula:

$$\text{buckling load } P_E=\pi^2EI/4L^2$$

wherein E, L and I are as defined above, the length of the protrusion changes its optimum range depending on the physical properties of the material and the cross-sectional shape. That is, as the ratio of length to cross-sectional area of the protrusion becomes higher, the buckling phenomenon takes place more frequently. If the protrusions are outside the applicable range of Euler's buckling formula, it becomes impossible that the protrusions in the intermediate layer undergo the buckling phenomenon. Then, the deformation of the ball is restrained, failing to achieve the benefit of the invention that when hit at a relatively high head speed as with a driver, the ball is substantially deformed by virtue of the buckling of the protrusions thereby accomplishing a reduced backspin rate, an increased launch angle and a drastically increased carry.

The shape of protrusions is not critical and they may be formed to an appropriate shape such as prism, cylinder, frusto-pyramid, or frusto-cone. The top of the protrusion preferably has a rounded planar shape. Then the protrusion become more flexible since the boundary conditions become approximate to fixed end/free end column conditions.

The total number of protrusions is usually about 80 to about 600, preferably about 90 to about 500. The protrusions are distributed on the spherical surface of the intermediate layer, preferably in a well-know symmetric arrangement, for example, a regular octahedral or regular icosahedral arrangement.

Since the material of the protrusions extending from the core or cover into the intermediate layer is harder than the material of the intermediate layer and falls within the applicable range of Euler's buckling formula used in the strength-of-materials theory, the benefit of the invention is achieved when hit at a relatively high head speed as with a driver, the ball is substantially deformed by virtue of the buckling of the protrusions thereby accomplishing a reduced backspin rate, an increased launch angle and a drastically increased carry. When the ball is struck at a relatively low head speed, typically with a short iron, the protrusions do not give rise to a buckling phenomenon and the ball undergoes only small deformation, which provides an increased backspin rate and maintains ease of control as conventional.

Now the respective components of the golf ball are described.

The solid core 2 may be formed of any desired material although vulcanizable rubber primarily comprising polybutadiene rubber, polyisoprene rubber, natural rubber or silicone rubber is often used. For high resilience, vulcanizable rubber primarily comprising polybutadiene is preferred.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent may also be blended, preferably in an amount of about 0.1 to 5 parts by weight per 100 parts by weight of the base rubber. In the rubber composition, zinc oxide or barium sulfate may be blended as an antioxidant or specific gravity adjusting filler. The amount of filler blended is preferably about 5 to 130 parts by weight per 100 parts by weight of the base rubber.

One preferred formulation of the solid core-forming rubber composition is given below.

| | Parts by weight |
|---|---|
| Cis-1,4-polybutadiene | 100 |
| Zinc oxide | 5 to 40 |
| Zinc acrylate | 15 to 40 |
| Barium sulfate | 0 to 40 |
| Peroxide | 0.1 to 5.0 |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

The solid core (excluding the protrusions) is preferably made to a diameter of 28 to 38 mm, more preferably 30 to 37 mm. Preferably the core has a Shore D hardness of 20 to 50, more preferably 25 to 45, and a deflection under a load of 100 kg of 2.5 to 5.0 mm, more preferably 3.0 to 4.5 mm. The weight of the core is usually about 12 to about 35.0 grams. The core is usually formed to a single layer structure from one material although it may also be formed to a multilayer structure of two or more layers of different materials if desired.

In one embodiment of the invention wherein protrusions 2*a* extend outward from the core 2 into the intermediate layer 3 as shown in FIG. 1, the core is formed on its outer surface with protrusions. Specifically, the cavity of a mold for forming the core is formed on its inner surface with a plurality of recesses corresponding to the plurality of protrusions. The core having a plurality of protrusions on its outer layer be formed by conventional molding using this mold. In some cases, protrusions may be adhesively joined to the core surface.

The intermediate layer-forming material is then formed around the core with protrusions by injection or compression molding whereupon the core protrusions are embedded in the intermediate layer.

The material of which the intermediate layer is made is not critical and may be either a resinous material or a rubbery material. For durability, resinous materials having good impact resistance are preferably used. Exemplary resins include polyester elastomers, ionomer resins, styrene elastomers, hydrogenated butadiene rubber and mixtures thereof. Use may be made of commercially available polyester elastomers such as Hytrel 3078, 4047, and 4767 from Toray Dupont K.K.

Using a suitable mold, the intermediate layer may be formed around the core by injection molding or compression molding. The intermediate layer preferably has a thickness of 1.0 to 6.0 mm, especially 2.0 to 5.0 mm.

In the other embodiment of the invention wherein protrusions 4*a* extend inward from the cover 4 into the intermediate layer 3 as shown in FIG. 2, the intermediate layer at its outer surface is provided with a plurality of recesses, preferably at the same time as its molding. Specifically, the cavity of a mold for forming the intermediate layer is formed on its inner surface with a plurality of protrusions corresponding to the plurality of recesses. This mold enables that the intermediate layer having a plurality of recesses in its outer surface be formed by conventional injection molding. In some cases, after a smooth intermediate layer is formed around the core, recesses can be formed in the intermediate layer by engraving, drilling or any other means.

The cover material is then molded around the intermediate layer having a plurality of recesses in its outer surface by conventional injection or compression molding, whereby the cover having protrusions embedded in the intermediate layer is formed.

Any of well-known cover stocks may be used in forming the cover 3. The cover material may be selected from ionomer resins, polyurethane resins, polyester resins and balata rubber. Use may be made of commercially available ionomer resins such as Surlyn (du Pont) and Himilan (Mitsui Dupont Polychemical K.K.

Additives such as titanium dioxide and barium sulfate may be added to the cover stock for adjusting the specific gravity and other properties thereof. Other optional additives include UV absorbers, antioxidants, and dispersants such as metal soaps. The cover may have a single layer structure of one material or be formed to a multilayer structure from layers of different materials.

The cover excluding the protrusions preferably has a thickness of 0.5 to 4.0 mm, more preferably 1.0 to 2.5 mm. The cover resin preferably has a Shore D hardness of 40 to 70, more preferably 50 to 65.

The golf ball has a multiplicity of dimples in its surface. The ball on its surface is subject to finishing treatments such as painting and stamping, if necessary. The golf ball as a whole preferably has a hardness corresponding to a deflection of 2.6 to 4.0 mm, more preferably 2.8 to 3.8 mm, under a load of 100 kg. The golf ball must have a diameter of not less than 42.67 mm and a weight of not greater than 45.93 grams in accordance with the Rules of Golf.

Since the protrusions extending from the core or cover are embedded in the intermediate layer, made of a harder material than the material of the intermediate layer, and satisfy the applicable range of Euler's buckling formula, the golf ball of the invention has the following benefits. When hit at a relatively high club head speed as with a driver, the ball is substantially deformed by virtue of the buckling of the protrusions thereby accomplishing a reduced backspin rate, an increased launch angle and an increased carry. When the ball is struck at a relatively low head speed, typically with a short iron, the protrusions do not buckle and the ball undergoes small deformation, which provides an increased backspin rate and maintains ease of control. With respect to the "feel" of the ball when hit, the ball gives a feel in proportion to the amount of deformation, that is, a soft pleasant feel on driver shots.

EXAMPLE

Examples of the invention are given below by way of illustration and not by way of limitation.

Examples 1–5 & Comparative Examples 1–5

Solid cores A to F were formed by working rubber compositions of the formulation shown in Table 1 in a kneader and molding and vulcanizing them in molds at a temperature of 155° C. for about 15 minutes. Intermediate layers were formed around the cores by injection molding resin compositions of the formulation shown in Table 2. The combination of core and intermediate layer is shown in Table 3. Covers were formed around the intermediate layers by injection molding cover stocks of the formulation shown in Table 2. The combination of cover with other components is shown in Table 3. There were obtained three-piece golf balls of Examples 1–5 and Comparative Examples 1–5.

The intermediate layer-forming molds used in Examples 1–5 and Comparative Examples 3–5 had cylindrical protrusions distributed on their cavity-defining inner surface in a regular octahedral arrangement. At the same time as molding of the intermediate layer, a plurality of recesses in its surface. The cover material penetrated into the recesses are formed whereby the protrusions from the cover were embedded in the intermediate layer. The number, cross-sectional shape, cross-section size (diameter) and length of the protrusions are reported in Table 3. In the balls of Examples 1–5, the protrusions satisfy the applicable range of Euler's buckling formula, as seen from the protrusion coefficient.

These golf balls were examined for hardness, flight performance and feel by the following tests. The results are shown in Table 4.

Ball Hardness

Hardness is expressed by a deflection (mm) under a load of 100 kg.

Flight Performance

Using a swing robot, the golf ball was struck with different clubs at different head speeds (HS). A spin rate, initial velocity, carry, and roll were measured.

(1) driver (W#1), HS 45 m/s (2) driver (W#1), HS 35 m/s (3) No. 5 iron (I#5), HS 39 m/s (4) No. 9 iron (I#9), HS 35 m/s The driver club used was Tour Stage X100 with a loft angle of 10°, and the iron club was Tour Stage X1000, both available from Bridgestone Sports Co., Ltd.

Feel

The balls were hit by three professional golfers using a driver and pitching wedge. The feel of the balls upon impact was rated by the golfers according to the following criteria.

Exc.: excellent feel

Good: good feel

Fair: ordinary feel

Poor: unpleasant feel

TABLE 1

| | Core | | | | | |
|---|---|---|---|---|---|---|
| Rubber compound (pbw) | A | B | C | D | E | F |
| JSR BR01*1 | 100.0 | 100.0 | 100.0 | 100.0 | 100.0 | 100.0 |
| Zinc acrylate | 20.0 | 20.0 | 25.0 | 25.0 | 25.0 | 25.0 |
| Zinc oxide | 10.0 | 10.0 | 10.0 | 10.0 | 10.0 | 10.0 |
| Barium sulfate | 10.2 | 17.4 | 10.1 | 6.7 | 14.5 | 7.5 |
| Dicumyl peroxide | 1.2 | 1.2 | 1.2 | 1.2 | 1.2 | 1.2 |

*1polybutadiene rubber by Nippon Synthetic Rubber K. K.

TABLE 2

| | Intermediate layer/Cover | | | | |
|---|---|---|---|---|---|
| Resin blend (pbw) | 1 | 2 | 3 | 4 | 5 |
| Hytrel 3078*2 | 100.0 | — | — | — | — |
| Hytrel 4047*2 | — | 100.0 | — | — | — |
| Hytrel 4767*2 | — | — | 100.0 | — | — |
| Himilan 1605*3 | — | — | — | 50.0 | — |
| Himilan 1650*3 | — | — | — | — | 40.0 |
| Himilan 1706*3 | — | — | — | 50.0 | — |
| Surlyn 8120*4 | — | — | — | — | 60.0 |
| Titanium oxide | — | — | — | 5.0 | 5.0 |

*2polyester base thermoplastic elastomer by Toray Dupont K. K.
*3ionomer resin by Mitsui Dupont Polychemical K. K.
*4ionomer resin by E. I. duPont

TABLE 3

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Core | | | | | | | | | | |
| Compound | A | B | C | D | E | B | C | F | B | C |
| Diameter (mm) | 36.3 | 30.5 | 35.3 | 32.3 | 28.3 | 30.5 | 35.3 | 35.3 | 30.5 | 35.3 |
| Weight (g) | 28.4 | 17.5 | 26.4 | 19.9 | 13.9 | 17.5 | 26.4 | 26.1 | 17.5 | 26.4 |
| Specific gravity | 1.134 | 1.176 | 1.147 | 1.127 | 1.172 | 1.176 | 1.147 | 1.132 | 1.176 | 1.147 |
| Hardness (mm)*5 | 4.1 | 3.9 | 3.5 | 3.3 | 3.4 | 3.9 | 3.5 | 3.5 | 3.9 | 4.0 |
| Intermediate layer | | | | | | | | | | |
| Blend | 3 | 1 | 2 | 1 | 2 | 1 | 2 | 3 | 1 | 2 |
| Diameter (mm)*6 | 40.3 | 38.5 | 40.3 | 40.3 | 40.3 | 38.5 | 40.3 | 40.3 | 38.5 | 40.3 |
| Thickness (mm) | 2.0 | 4.0 | 2.5 | 4.0 | 6.0 | 4.0 | 2.5 | 2.5 | 4.0 | 2.5 |
| Weight (g)*6 | 39.0 | 34.7 | 39.0 | 39.0 | 39.0 | 34.7 | 39.0 | 39.0 | 34.7 | 39.0 |
| Specific gravity | 1.15 | 1.15 | 1.12 | 1.15 | 1.12 | 1.15 | 1.12 | 1.15 | 1.15 | 1.12 |
| Hardness (mm) | 3.7 | 3.9 | 3.3 | 3.4 | 3.3 | 3.9 | 3.3 | 3.3 | 3.8 | 3.7 |
| Hardness (Shore D) | 47 | 30 | 40 | 30 | 40 | 30 | 40 | 47 | 30 | 40 |
| Cover | | | | | | | | | | |
| Blend | 4 | 4 | 5 | 5 | 5 | 4 | 5 | 5 | 4 | 5 |
| Thickness (mm) | 1.2 | 2.1 | 1.2 | 1.2 | 1.2 | 2.1 | 1.2 | 1.2 | 2.1 | 1.2 |
| Weight (g) | 6.3 | 10.6 | 6.3 | 6.3 | 6.3 | 10.6 | 6.3 | 6.3 | 10.6 | 6.3 |
| Specific gravity | 0.97 | 0.97 | 0.97 | 0.97 | 0.97 | 0.97 | 0.97 | 0.97 | 0.97 | 0.97 |
| Hardness (Shore D) | 62 | 62 | 52 | 52 | 52 | 62 | 52 | 52 | 62 | 52 |
| Young's modulus (MPa) | 270 | 270 | 90 | 90 | 90 | 270 | 90 | 90 | 270 | 90 |
| Yield stress (MPa) | 14.9 | 14.9 | 10.4 | 10.4 | 10.4 | 14.9 | 10.4 | 10.4 | 14.9 | 10.4 |
| Protrusions | | | | | | | | | | |
| Number | 344 | 152 | 344 | 152 | 120 | nil | nil | 344 | 152 | 344 |
| Cross-section shape | circular | circular | circular | circular | circular | | | circular | circular | circular |
| Cross-section size (mm) | 0.5 | 1.0 | 1.0 | 1.5 | 2.5 | | | 1.0 | 4.0 | 4.0 |
| Length (mm) | 2.0 | 4.0 | 2.5 | 4.0 | 6.0 | | | 2.5 | 4.0 | 2.5 |
| Protrusion coefficient*7 | 1.7 | 3.3 | 2.3 | 3.5 | 5.8 | | | 2.3 | 13.4 | 9.2 |

*5deflection (mm) under a load of 100 kg
*6value for core and intermediate layer combined
*7$\pi(EI/A\sigma_b)^{1/2}$ wherein E is the Young's modulus (MPa) of the cover material, I is the geometrical moment of inertia ($mm^4$) of the protrusion, A is the cross-sectional area ($mm^2$) of the protrusion, and $\sigma_b$ is the yield stress (MPa) of the cover material.

TABLE 4

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Ball | | | | | | | | | | |
| Diameter (mm) | 42.7 | 42.7 | 42.7 | 42.7 | 42.7 | 42.7 | 42.7 | 42.7 | 42.7 | 42.7 |
| Weight (g) | 45.3 | 45.3 | 45.3 | 45.3 | 45.3 | 45.3 | 45.3 | 45.3 | 45.3 | 45.3 |
| Hardness (mm) | 3.0 | 3.1 | 3.2 | 3.5 | 3.2 | 3.1 | 3.2 | 3.1 | 3.0 | 3.6 |
| W#1/HS45 | | | | | | | | | | |
| Spin (rpm) | 2920 | 2760 | 2790 | 2760 | 2690 | 2930 | 3140 | 3080 | 2890 | 3070 |
| Carry (m) | 215.3 | 214.9 | 215.7 | 214.6 | 213.1 | 212.9 | 209.0 | 212.4 | 213.7 | 210.1 |
| Total (m) | 220.6 | 223.5 | 223.2 | 222.4 | 219.8 | 218.7 | 215.8 | 217.6 | 219.4 | 216.5 |
| Initial velocity (m/s) | 68.0 | 68.1 | 68.1 | 68.0 | 67.9 | 68.0 | 67.9 | 68.0 | 68.1 | 67.9 |
| W#1/HS35 | | | | | | | | | | |
| Spin (rpm) | 4360 | 4130 | 4160 | 4100 | 4010 | 4360 | 4690 | 4600 | 4140 | 4590 |
| Carry (m) | 142.7 | 141.2 | 141.5 | 140.8 | 139.7 | 139.7 | 137.1 | 139.0 | 140.9 | 138.3 |
| Total (m) | 158.4 | 160.4 | 160.2 | 159.1 | 157.2 | 156.0 | 154.3 | 155.8 | 155.7 | 154.9 |
| I#5/HS39 | | | | | | | | | | |
| Spin (rpm) | 6590 | 6270 | 6230 | 6200 | 6150 | 5900 | 6120 | 6030 | 5720 | 6060 |
| Carry (m) | 153.9 | 155.3 | 155.1 | 154.8 | 154.7 | 156.8 | 154.1 | 155.1 | 155.1 | 155.7 |
| Total (m) | 156.9 | 159.7 | 159.0 | 159.2 | 158.9 | 163.5 | 159.8 | 160.0 | 162.8 | 161.2 |
| Roll (m) | 3.0 | 4.4 | 3.9 | 4.4 | 4.2 | 6.7 | 5.7 | 4.9 | 7.7 | 5.5 |
| I#9/HS35 | | | | | | | | | | |
| Spin (rpm) | 9570 | 9210 | 9090 | 9070 | 9030 | 8200 | 8900 | 8750 | 8070 | 8560 |
| Carry (m) | 124.0 | 125.2 | 124.9 | 125.0 | 124.7 | 125.4 | 124.2 | 125.0 | 127.3 | 126.2 |
| Total (m) | 125.2 | 127.2 | 127.1 | 126.9 | 126.4 | 131.5 | 127.4 | 127.4 | 133.5 | 130.7 |
| Roll (m) | 1.2 | 2.0 | 2.2 | 1.9 | 1.7 | 6.1 | 3.3 | 2.4 | 6.2 | 4.5 |
| Feel | | | | | | | | | | |
| Driver | Exc. | Good | Exc. | Good | Fair | Fair | Good | Good | Fair | Good |
| Pitching wedge | Exc. | Exc. | Exc. | Exc. | Good | Poor | Poor | Poor | Poor | Poor |

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golfball, comprising: a core having a deflection under load of 100 Kg of 2.5–5.0 mm, an intermediate layer around the core, and a cover around the intermediate layer, wherein the intermediate layer is a material selected from the group consisting of polyester elastomer, ionomer resin, styrene elastomer, hydrogenated butadiene rubber and mixtures thereof, said cover is a material selected from the group consisting of ionomer resin, polyurethane resin, polyester resin and balata, and is integrally provided with a plurality of protrusions penetrating into the intermediate layer distributed on the spherical surface of said intermediate layer in a regular octahedral arrangement or a regular icosahedral arrangement, the protrusions having a Shore D hardness which is at least 8 units higher than the Shore D hardness of the intermediate layer, each of said protrusions satisfying the relationship:

$$L>\pi(EI/A\sigma_b)^{1/2}$$

wherein L is the length (mm) of the protrusion, E is the Young's modulus (MPa) of the material of the protrusion, I is the geometrical moment of inertia ($mm^4$) of the protrusion, A is the cross-sectional area ($mm^2$) of the protrusion, and $\sigma_b$ is the yield stress (MPa) of the protrusion.

2. The golf ball of claim 1, wherein said protrusions have a rounded planar top shape.

3. The golf ball of claim 1, wherein said intermediate layer has a Shore D hardness in the range of 15 to 55.

4. The golf ball of claim 1, wherein said protrusion has a length in the range of 1.0 to 6.0 mm and a transverse cross-section in the range 0.5 to 5.0 mm.

5. The golf ball of claim 1, wherein the total number of protrusions is in the range of 80 to 600.

6. The golf ball of claim 1, wherein said core is solid and has a Shore D hardness in the range of 20 to 50.

7. The golf ball of claim 1, wherein said core has a diameter in the range of 28 to 38 mm and a weight in the range of 12 to 35.0 g.

8. The golf ball of claim 1, wherein said intermediate layer has a thickness of 1.0 to 6.0 mm.

9. The golf ball of claim 1, wherein said cover has a thickness in the range of 0.5 to 4.0 mm.

* * * * *